United States Patent [19]

Dobija

[11] 4,109,426

[45] Aug. 29, 1978

[54] TUB SURROUND

[75] Inventor: Michael J. Dobija, New Philadelphia, Ohio

[73] Assignee: Masonite Corporation, Chicago, Ill.

[21] Appl. No.: 776,130

[22] Filed: Mar. 10, 1977

[51] Int. Cl.[2] ..... A47K 3/16

[52] U.S. Cl. ..... 52/35; 52/288

[58] Field of Search ..... 52/288, 35, 261, 464, 52/468, 470

[56] References Cited

U.S. PATENT DOCUMENTS

| | | | |
|---|---|---|---|
| 2,114,044 | 4/1938 | Bonnell | 52/288 |
| 2,423,722 | 7/1947 | Nilson | 52/288 |
| 3,996,703 | 12/1976 | Daniels | 52/35 |
| 4,020,602 | 5/1977 | Daniels | 52/35 |
| 4,028,856 | 6/1977 | Dalbec | 52/288 |

*Primary Examiner*—Price C. Faw, Jr.
*Assistant Examiner*—Henry Raduazo
*Attorney, Agent, or Firm*—Ronald B. Coolley

[57] ABSTRACT

A tub surround includes first and second identical corner sections and first, second and third identical panel portions. The tub surround is assembled by positioning a first panel between the two corner sections thereby defining one wall. The remaining panel sections are joined with each of the corner portions to define second and third walls. Each corner section includes first and second legs extending at right angles from each other. The ends of the legs extending from the corner sections lie on a plane parallel to and separated from the plane of each side thereby defining a joint behind which the edges of the panels may be positioned. The corner sections further include shelves extending between the legs of the corner sections.

2 Claims, 3 Drawing Figures

TUB SURROUND

BACKGROUND OF THE INVENTION

A. Field of the Invention

The device of the present invention relates to a new and improved tub surround intended to be mounted within a wall recess and above and around a bathtub.

B. Description of the Prior Art

In building or remodeling homes that employ wallboards for the walls it is desired to secure to the walls a moisture and water proof covering around bathtubs and showers. Typically this is accomplished through the employment of a tub surround that includes one or more members that are joined together to surround the tub. The members extend from the tub ledge upwardly to a point above the height of the shower head thereby protecting the wallboard from splashing water. Examples of typical prior art tub surrounds are illustrated in U.S. Pat. Nos. 2,677,268; 3,740,908 and 3,977,136.

Tub surrounds are positioned within a recess built around a bathtub or shower. In modern construction the dimensions of the recess may vary slightly resulting in walls that may be out of plumb and tub flanges that are not perfectly horizontal. Accordingly, it is desirable that the tub surround be able to accommodate these variations. This may be accomplished by the use of overlapping the joints of the various components of the tub surround. By using different joints, however, many of the parts of the tub surround may not be substituted or interchanged and each may not always be of a standard size and configuration, thus reducing the utility of the tub surround.

In addition, due to the construction and configuration, typical prior art tub surrounds do not provide additional useful features such as shelves or the like.

SUMMARY OF THE INVENTION

An object of the present invention is to provide a new and improved tub surround.

Another object of the present invention is to provide a new and improved tub surround that includes multiples of only two different components.

A further object of the present invention is to provide a new and improved tub surround including components of a standard size that simplify handling, manufacturing and installation as well as provide shipping economy.

An additional object of the present invention is to provide a new and improved tub surround that includes shelves that may be varied for shower or bathtub levels.

Briefly, the present invention is directed to a new and improved tub surround that includes three flat panels of substantially identical configuration and size, and two corner sections that are also substantially identical in configuration and size. The corner sections are defined by two sides joined at one end of each to define a right angle.

The ends of the sides extending from the right angle lie in a plane parallel to but spaced from the plane of the sides thereby defining an overlay behind which the sides of the panels may be positioned to define a joint. Due to this overlapping or overlying joint, the panels may be cut to size with the cut edges positioned, and thus hidden, behind the overlying portion of the corner section. In addition, variation in the vertical positioning of the corners and panel sections is available due to the overlapping nature of the joints. These two features allow custom fitting of the tub surround to a recess surrounding a bathtub that is out of plumb.

Moreover, since the panels are all of the same configuration and size and are flat, they may be mass produced with different finishes thereby providing marketing and design flexibility by allowing a large selection of panels to provide the desired decoration.

The corner sections also include shelves defined between the sides of each corner section. These shelves may be defined on only a vertical upper or lower half portion of the corner sections such that the corners may be inverted to provide shelves at a higher or lower level corresponding to the shower or at tub level, respectively.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DETAILED DESCRIPTION OF THE PREFERRED EMBODIMENT

Figure 1:
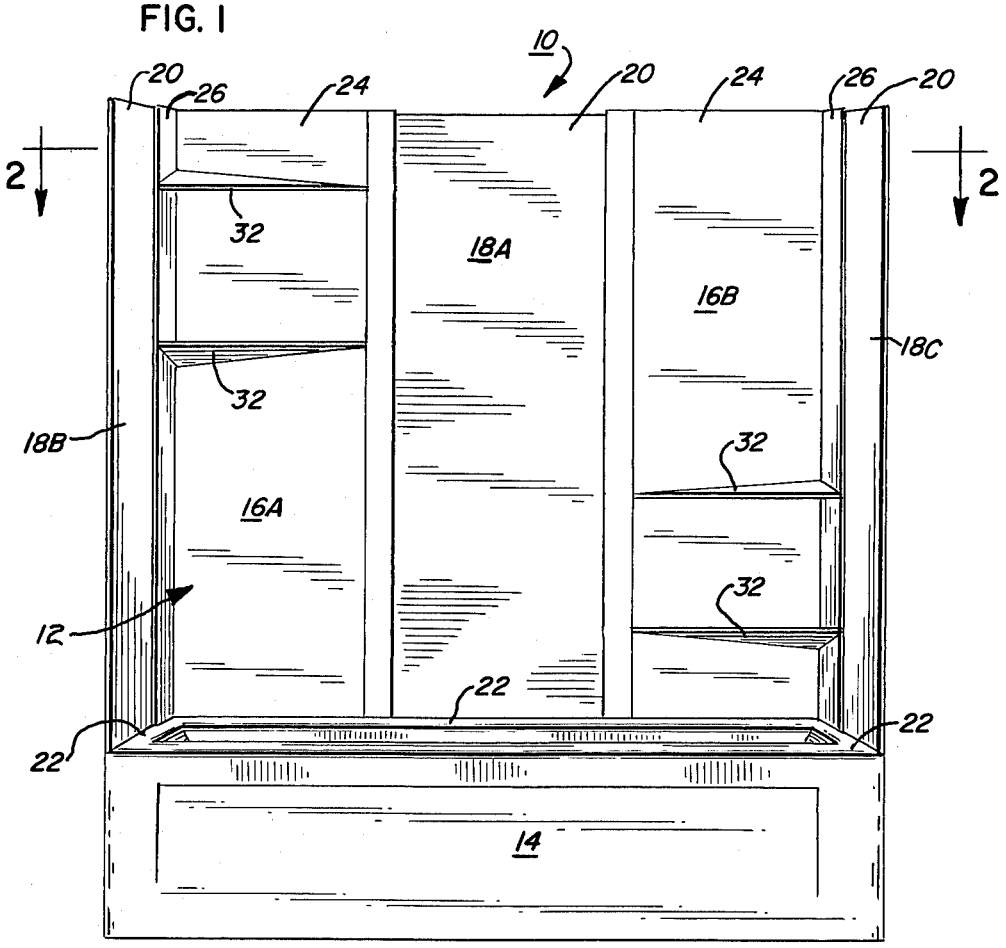
FIG. 1 is a perspective view of a tub surround assembled in a recess in which a bathtub is positioned.

Having reference now to the figures and initially to FIG. 1, there is illustrated a tub surround generally designated by the reference numeral 10. The tub surround 10 is of the type that may be mounted within a recess 12 in a house or home within which is positioned a bathtub such as the tub 14.

The tub surround 10 serves the function of preventing water from the tub or shower to contact the wallboard or the like that defines the recess 12 into which the tub 14 is positioned. Wallboard of this type is typically made of chalk that when subjected to moisture or water will deteriorate. Consequently, a tub surround such as that illustrated is beneficial.

In addition, the tub surround 10 is of a construction that if the recess 12 is not exactly in plumb due to variations in the material or movement or settling of the house or building, the tub surround 10 may accomodate such variations.

The tub surround 10 includes five pieces; however, these five pieces are multiples of only two different components. The first component is a corner section or member, for example section 16A, and the second component is a rectangular shaped panel such as, for example, panel 18A. The complete tub surround 10 includes two corner sections 16A and 16B and three panels 18A, 18B and 18C. The panels 18A, 18B and 18C and corner sections 16A and 16B are of uniform height.

The panels 18A, 18B and 18C are of a substantially identical shape and configuration and may have several different coatings on the surface 20 facing the inside of the recess 14. This allows mass production and provides the purchaser with a multitude of choices as to the color and design of the surround 10.

The tub surround 10 is positioned on the upper flange or edge 22 of the tub 14 and extends upwardly to the desired height; preferably, above that level to which splashing water is expected to hit. The complete tub surround 10, once assembled, includes the two corner portions 16A and 16B positioned within the two corners of the recess 12. Positioned between the corner portions 16A and 16B is the panel 18A, and extending at right angles to panel 18A and adjacent to the respective corner portions 16A and 16B are the panels 18B and 18C, respectively.

More specifically, each of the corner sections 16A and 16B includes a long leg or side 24 and a short leg or side 26. The legs 24 and 26 for each of the corner portions 16A and 16B lie in planes substantially at right angles to each other.

In addition, each of the legs, 24 and 26, includes and end 28 that extends from the point of connection of the two legs 24 and 26. Each extending end 28 lies in a plane that is displaced from the planes in which the sides 24 and 26 lie. This plane in which each end 28 lies is parallel but spaced from the planes of the legs 24 and 26. The extending ends 28 and their position relative to the sides 24 and 26 define a lap joint that, upon assembly of the tub surround 10, overlie the corresponding edges of the panels 18A, 18B and 18C.

Figure 2:
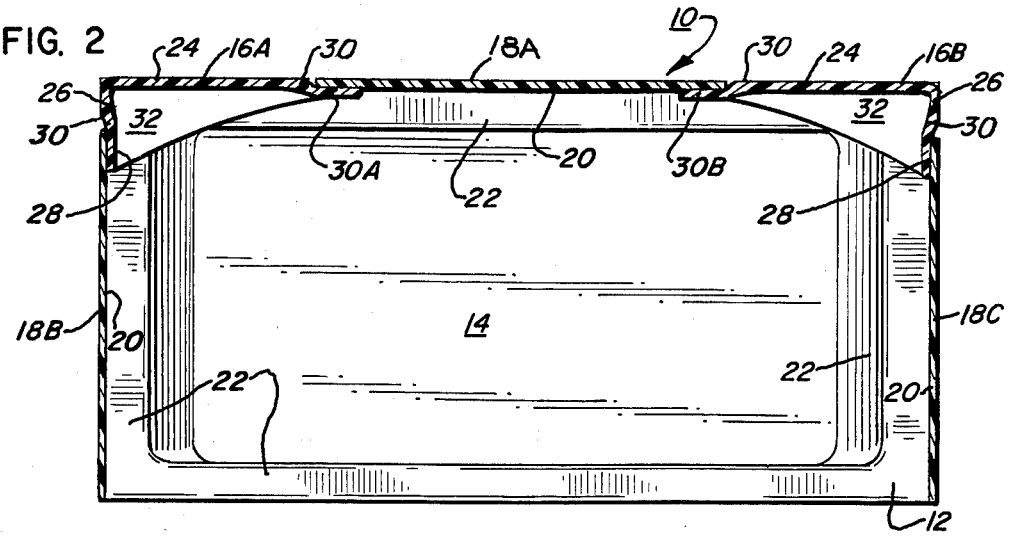
FIG. 2 is a horizontal sectional view taken along line 2—2 of FIG. 1.

For example, with reference now to FIG. 2, the edges of the panel 18A lie behind the extending ends 28 on the long legs 24 of the corner sections 16A and 16B. Moreover, the one edge of the panel 18B lies behind the extending end 28 on the short leg 26 of corner section 16A, whereas the similar edge of the panel 18C is behind the extending end 28 on the short leg 26 of corner section 16B. This type of joint defined by the overlapping of the extending ends 28 allows variations in the assembly of the tub surround 10. If, for example, the recess 14 in which the tub surround 10 is to be assembled is out of plumb or of a non-standard size, the edges of the panels 18A, 18B and 18C may be cut so that the panels 18A, 18B and 18C are of the desired size and the sides are at the desired angles such that the bottoms of the panels 18A, 18B and 18C may be securely mounted on the tub flange 22. The edge or edges cut on the panels 18A, 18B or 18C may then be placed behind the extending edges 28 so as to hide them from sight.

In this manner, standard panels 18A, 18B and 18C and standard corner sections 16A and 16B may be employed and the installer of the tub surround 10 may cut the panels 18A, 18B and 18C at the work site to accomodate the varying sizes of recesses 14. A sealer of any preferred type may then be secured to the back of the extending ends 28 to secure the edge of the panels 18A, 18B and 18C to the extending edges 28 thereby assembling the tub surround 10.

Figure 3:
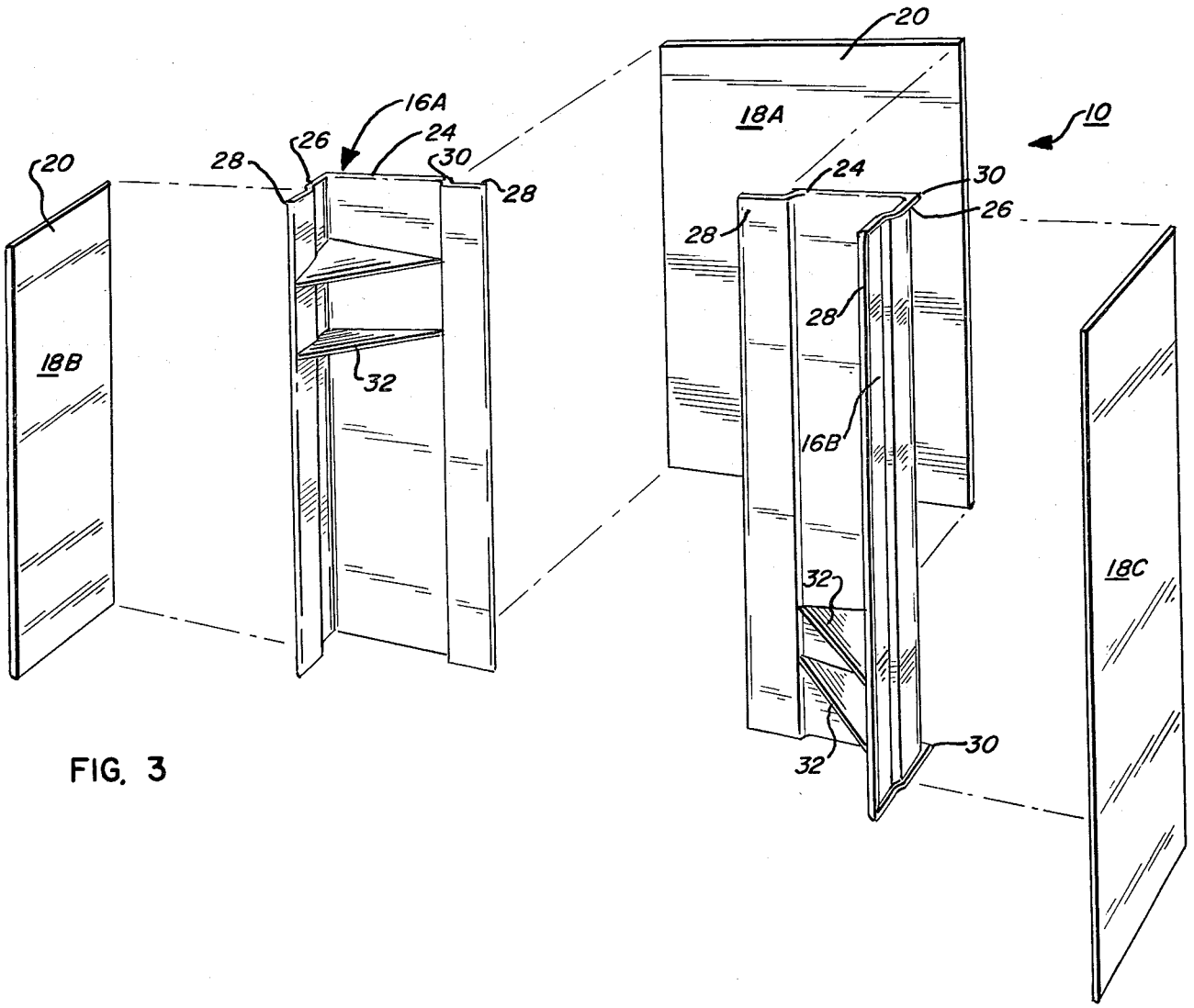
FIG. 3 is an exploded perspective view of the tub surround illustrated in FIG. 1.

To assist in aligning up the panels 18A, 18B and 18C behind the extending edges 28, the corner portions 16A and 16B include identical upper and lower flanges 30 (FIG. 3). These flanges 30 define an edge against which the edges of the panels 18A, 18B and 18C may abut upon assembly of the tub surround 10. In addition, the bottom flange 30 is positioned on top of the tub flange 22 to allow positioning of the tub surround onto and above the tub 14.

In accordance with an important feature of the present invention, the corner portions 16A and 16B also include a plurality of shelves 32. The shelves 32 are defined between and within the legs 24 and 26 on each of the corner portions 16A and 16B. Preferably, these shelves 32 are defined on only a portion of the tub surround 10; for example, on only a half of the vertical length of the corner portions 16A and 16B. In this manner, the shelves 32 may be in a first position such as on corner portion 16A in FIG. 1 so that the shelves 32 are at a level that would be convenient during a shower. In addition, the corner portions 16A and 16B may be inverted to the orientation illustrated by corner portion 16B in FIG. 1 wherein the shelves 32 are at the lower half of the corner portion 16B and convenient for an individual taking a bath.

Additional shelves may be added extending the entire length of the corner portions 16A and 16B, however, and the inversion of the corner portion 16A or 16B would then not be necessary to provide shelves at the desired level.

Many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A tub surround comprising: first and second substantially identical corner sections, each including first and second legs aligned substantially perpendicular to each other and of unequal length, each said leg including a planar extending free end along the full height of each said corner section being offset relative to the plane of each such leg;

a first planar panel positioned between said corner sections defining a first wall, said first panel including first and second edges, each said first and second edge underlying one of said free ends;

a second planar panel positioned adjacent said first corner section defining a second wall, said second panel including an edge underlying another free end of said first corner section;

a third planar panel positioned adjacent said second corner section defining a third wall, said third panel including an edge underlying another free end of said second corner section;

said first, second and third panels being of substantially identical configuration and size; and shelves on each said corner section extending between said first and second legs, said shelves defined on only a portion of the length of each said corner section, said shelves on said first corner section being defined on an upper portion of said first corner section and said shelves on said second corner section being defined on a lower portion of said second corner section such that upon assembly of said tub surround said shelves on said first corner section are at a different level relative to a tub than the shelves on said second corner section.

2. The tub surround claimed in claim 1 wherein each said free end of said corner sections lies in a plane parallel to the plane of each said respective leg of said corner sections.

* * * * *